US008156759B2

(12) United States Patent
Nevatia

(10) Patent No.: US 8,156,759 B2
(45) Date of Patent: Apr. 17, 2012

(54) HINGE AND ITS APPLICATION IN JEWELRY MAKING

(76) Inventor: Shishir Balkrishna Nevatia, Maharashtra (IN)

( * ) Notice: Subject to any disclaimer, the term of this patent is extended or adjusted under 35 U.S.C. 154(b) by 401 days.

(21) Appl. No.: 12/520,754

(22) PCT Filed: Dec. 14, 2007

(86) PCT No.: PCT/IN2007/000596

§ 371 (c)(1),
(2), (4) Date: Jun. 22, 2009

(87) PCT Pub. No.: WO2008/078335

PCT Pub. Date: Jul. 3, 2008

(65) Prior Publication Data

US 2010/0024483 A1 Feb. 4, 2010

(30) Foreign Application Priority Data

Dec. 22, 2006 (IN) ..... 2098/MUM/2006

(51) Int. Cl.
*A44C 5/02* (2006.01)
*A44C 17/07* (2006.01)
*F16G 13/12* (2006.01)

(52) U.S. Cl. ..... 63/9; 63/38; 63/3; 59/80; 59/82

(58) Field of Classification Search ..... None
See application file for complete search history.

(56) References Cited

U.S. PATENT DOCUMENTS 377,120 A * 1/1888 Schofield ..... 474/232
761,867 A * 6/1904 Artopoens ..... 63/26
942,356 A * 12/1909 Shelley ..... 59/27
1,189,497 A * 7/1916 Schwartzman ..... 59/80
1,483,274 A * 2/1924 Bouschor ..... 403/353
2,136,818 A * 11/1938 Kestenman ..... 59/80
2,584,207 A * 2/1952 Holl ..... 63/27
3,673,794 A * 7/1972 I'Anson ..... 59/35.1
3,750,390 A * 8/1973 Edwards ..... 59/78
3,990,314 A 11/1976 Priest
4,014,079 A * 3/1977 Camarda ..... 24/684
4,473,365 A * 9/1984 Lapeyre ..... 474/212
4,781,038 A * 11/1988 Branca et al. ..... 63/26
4,815,271 A * 3/1989 Lapeyre ..... 59/84
4,882,901 A * 11/1989 Lapeyre ..... 59/84
4,996,851 A * 3/1991 Schinzinger et al. ..... 63/26

(Continued)

*Primary Examiner* — Jack W. Lavinder
(74) *Attorney, Agent, or Firm* — Moore & Hansen, PLLC

(57) ABSTRACT

The present invention particularly relates to a novel type of hinge to be used for sequentially interconnecting different elemental jewelry units of a jewelry item. Type of hinge constructions used in jewelry making of prior art do not permit the jewelry item to retain during use its appropriate shape which is required for bringing out beauty value of the jewelry item like the diamond-studded necklace. The necklace may present itself as an ordinary metal chain, which, as if, "falls down loose", giving a U-shape or any other unplanned shape. Hinge-construction of prior art does not restrict movement of different elemental jewelry units in different unplanned directions. The difficulty becomes more pronounced when very small size diamonds are used in the necklace. The novel type of hinge of the present invention provides two mating pairs for each elemental jewelry units permit each unit to have predetermined appropriate amounts of clockwise and anticlockwise rotational motions. This helps the jewelry item to take and retain its planned appropriate shape to achieve gracefulness and beauty, giving very attractive and impressive appearance. Hinge-construction of present invention can be used for making different jewelry items such as necklace, bracelets, pendants, earrings and the like.

3 Claims, 7 Drawing Sheets

U.S. PATENT DOCUMENTS 5,339,655 A * 8/1994 Grando ..... 63/9
5,341,634 A * 8/1994 Straight ..... 59/80
5,343,718 A * 9/1994 Poll ..... 63/26
5,694,791 A * 12/1997 Esposito ..... 63/3
6,220,010 B1 4/2001 Gomez
6,742,359 B1 6/2004 Takessian
7,607,320 B2 * 10/2009 Perle ..... 63/38
7,802,449 B1 * 9/2010 Levitt ..... 63/28
2002/0000097 A1 1/2002 Butler

* cited by examiner

HINGE AND ITS APPLICATION IN JEWELRY MAKING

RELATED APPLICATIONS

This application is a 371 National Stage entry of PCT/IN2007/000596, filed on Dec. 14, 2007, which claims priority to Indian Patent Application Number 2098/MUM/2006, filed on Dec. 22, 2006.

FIELD OF INVENTION

This invention generally relates to jewelry making and particularly relates to a novel type of hinge to be used in interconnecting different elemental jewelry units.

DISCUSSION OF PRIOR ART

Hinges and hinge-based mechanisms are incredibly important mechanical devices and are vital to linkage systems used in jewelry-making.

For jewelers, applications of hinges are obviously in necklaces, bracelets, pendants, earrings and such other jewelry items.

The concept of a "hinge" obviously seems to be inextricably linked to rotation; that is, there are at least two parts that are joined or linked, and these rotate relative to each other. There are number of ways of accomplishing such relative movement or rotation.

Metals used in jewelry making are soft and rather unsuitable for building mechanisms such as hinges. Therefore, whenever a hinge is built in jewelry-making, initially it may be built very tightly. It will be found that within six months, it will be moving very freely. But, if one starts with a hinge that has any looseness to it, then it is likely to be floppy and sloppily loose down the road.

In simple hinge-construction, each small elemental jewelry unit shall have a jump ring and a wire. The wire of first elemental jewelry unit is passed through the jump ring of second elemental jewelry unit, then the wire is appropriately bent and soldered back to the first elemental jewelry unit. The bent and soldered wire may form an appropriate U-shape or ring shape, so that the jump ring and the U-shape can rotate with respect to each other and provide required flexibility to the overall jewelry item such as bracelet, necklace, pendant, earrings and the like.

A number of disadvantages and difficulties are associated with the use of this type of hinge-construction in jewelry-making, as explained below:

a. The above mentioned hinge-construction, when used in making a diamond necklace, does not permit this jewelry item to retain its proper shape, which is appropriate for bringing out the beauty-value of the necklace. Hence the necklace may present itself as an ordinary metal chain, which, as if, falls down, giving a U-shape or any other unplanned shape. This happens because such hinge-construction does not restrict movement of different elemental jewelry units in different unplanned directions. Hence the graceful appropriate shape of necklace is not obtained and retained.

b. The difficulty becomes more pronounced when very small size diamonds are used in making the diamond-studded necklace. The real appearance-value of necklace is obtained when the tables of all cut and polished diamonds of the necklace lie in such directions that all diamond-tables reflect light at approximately same time. If individual diamond-tables in the necklace are oriented in different directions at random, then this appearance-value effect will not be achieved. Exactly this is what happens when above mentioned hinge-construction of prior art is used in making the necklace. The individual collets, that is, the individual elemental jewelry units can freely rotate at random, become inclined and occupy differently oriented positions, so that all diamond-tables, when considered as a whole for the necklace, do not present a high-appearance-value for the necklace. This happens because there is no appropriate restriction provided to permit the predetermined amount of rotational movement of each individual elemental jewelry unit.

This is totally undesirable when one is aware of the fact that, it is the high-appearance and beauty-value of the necklace, which determines the commercial price of the necklace.

This is true for all other jewelry items like bracelets, earrings, pendants and the like.

In view of the above mentioned disadvantages and limitations of the hinge-construction of the prior art discussed earlier, there is a need for developing new hinge-construction and method of its making, for the jewelry items, to overcome these disadvantages and limitations.

OBJECTS AND ADVANTAGES OF PRESENT INVENTION

Accordingly, the objects and advantages of the present invention are described below:

An object of the present invention is to provide an efficient hinge-construction for use in jewelry making.

Another object of the present invention is to provide a hinge-construction permitting appropriate restricted and limited amount of clockwise and anticlockwise rotational movement of each of the individual elemental jewelry units of a jewelry item.

Yet another object of the present invention is to provide a hinge-construction which enhances appearance and beauty-value of a jewelry item.

Further objects and advantages of the present invention will become apparent from a consideration of accompanying drawings and ensuing description.

BRIEF DESCRIPTION OF DRAWINGS

The detailed description of the invention is accompanied by the drawings briefly described below.

NOMENCLATURE OF PARTS

| Ser. No. | Name of parts |
|---|---|
| 1-A, 1-B, 1-C | outer prongs |
| 2 | diamond |
| 3 | lower bezel |
| 4 | upper bezel |
| 5 | curved pin |
| 6 | slot in curved pin |
| 7-A, 7-B, 7-C | triangular prong |
| 8 | inner support for diamonds |
| 9 | rigid stub |
| 10 | jump ring |
| 11 | rigid pin |
| 12 | groove in lower bezel |
| 13 | stopper |
| J | elemental jewellery unit |

SUMMARY OF INVENTION

The present invention particularly relates to a novel type of hinge to be used for sequentially interconnecting different elemental jewelry units of a jewelry item. Type of hinge constructions used in jewelry making of prior art do not permit the jewelry item to retain during use its appropriate shape which is required for bringing out beauty value of the jewelry item like the diamond-studded necklace. The necklace may present itself as an ordinary metal chain, which, as if, "falls down loose", giving a U-shape or any other unplanned shape. Hinge-construction of prior art does not restrict movement of different elemental jewelry units in different unplanned directions. The difficulty becomes more pronounced when very small size diamonds are used in the necklace. The novel type of hinge of the present invention provides two mating pairs for each elemental jewelry unit permit each unit to have predetermined appropriate amounts of clockwise and anticlockwise rotational motions. This helps the jewelry item to take and retain its planned appropriate shape to achieve gracefulness and beauty, giving very attractive and impressive appearance. Hinge-construction of present invention can be used for making different jewelry items such as necklace, bracelets, pendants, earrings and the like.

DETAILED DESCRIPTION OF THE INVENTION

The method of application of this novel type of hinge of the present invention is illustrated here with respect to one type of jewelry item, that is, a necklace. However it should be noted that, this novel type of hinge can be used in making other jewelry items, such as, bracelet, pendant, earrings and the like.

Figure 1:
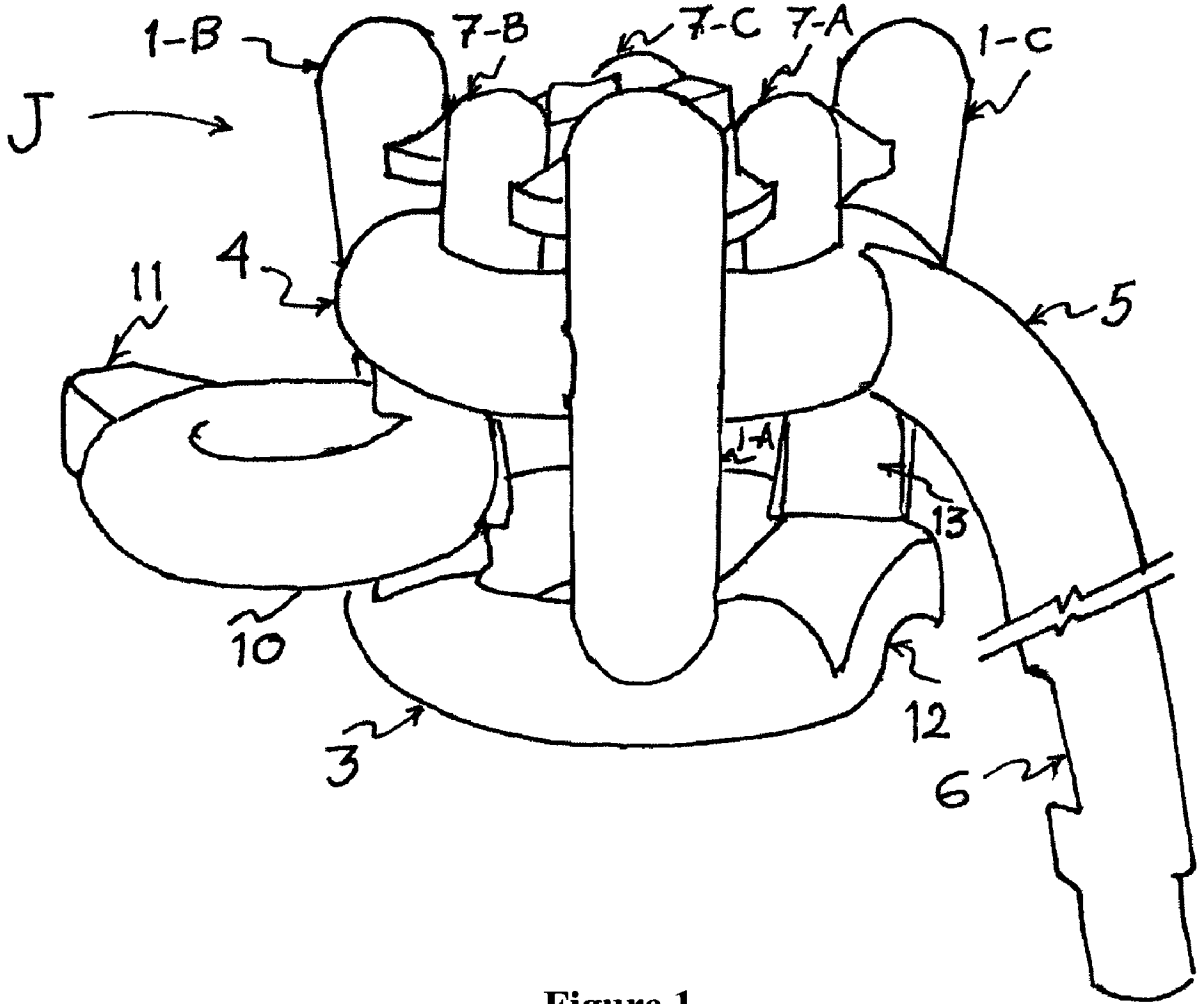
FIG. 1 shows individual elemental jewelry unit with its major components.
Figure 7:
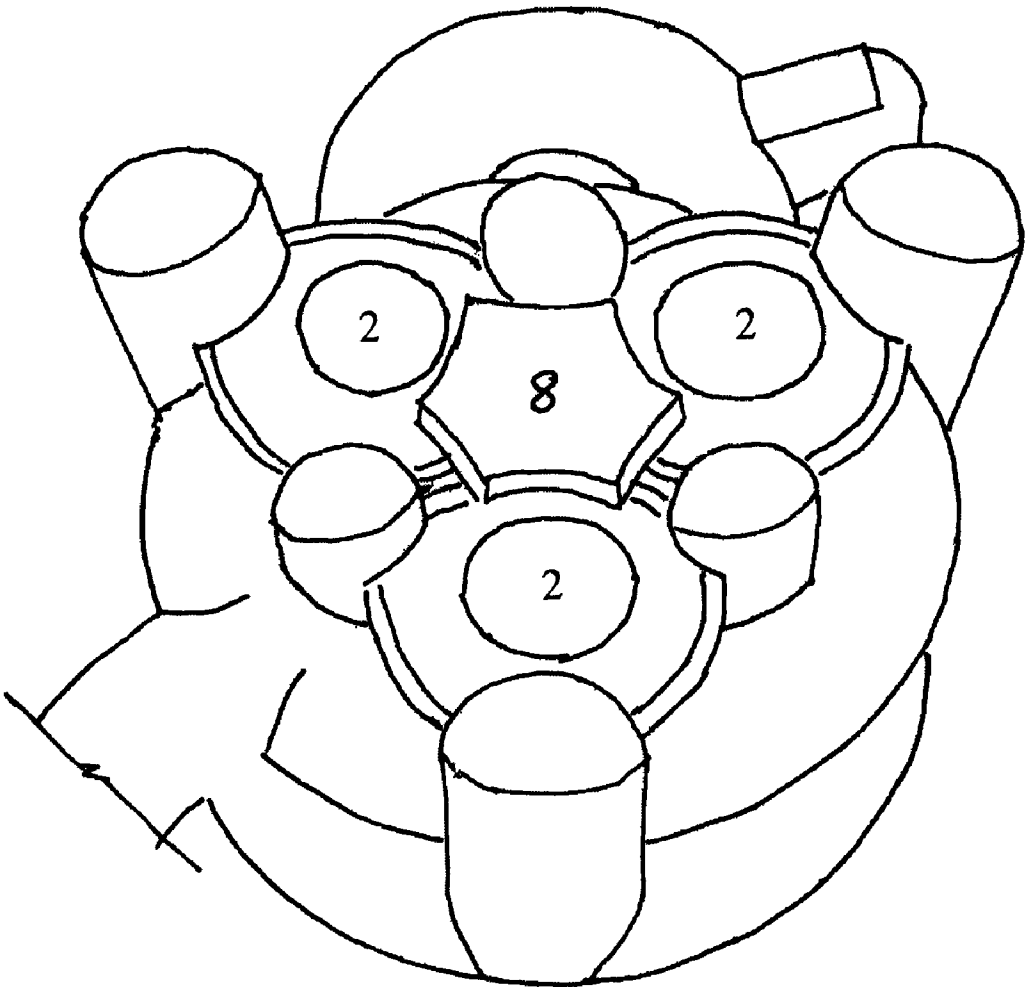
FIG. 7 shows diamond and triangular stopper arrangement of an elemental jewelry unit.

According to the most preferred embodiment of the present invention, the details of the components of a trinity collet, that is an elemental jewelry unit J, are shown schematically in FIG. 1. The outer prongs, 1-A, 1-B, and 1-C, with grooves for holding the gems such as diamonds 2 (not shown in FIG. 1, but shown in FIG. 7) are positioned such that their lower ends are fixedly connected to the lower bezel 3; near free upper ends of outer prongs 1-A, 1-B, and 1-C are provided, grooves on their inner surfaces for supporting edges of gem like diamond, and each of the outer prongs is also rigidly connected to outer surface of the upper bezel 4. This arrangement also ensures that the lower and upper bezels 3 and 4 are disposed approximately parallel to each other. A curved pin 5 of appropriate length and shape is rigidly connected to the outer surface of the bezel 4 and has a slot 6 made near other end thereof. The connecting area of curved pin 5 and upper bezel 4 is equidistant from two adjacent outer prongs 1-A and 1-C. The outer surface of an inner prong 7-A which is lying equidistantly from outer prongs 1-A and 1-C, is connected to the upper bezel 4 on bezel's inner surface, such that the curved pin 5 and the connected inner prong 7-A lie on opposite sides of curved portion of the upper bezel 4, such that the central longitudinal axis of inner prong 7-A and curved axis of curved pin 5 lie approximately in the same plane. The remaining two inner prongs 7-B and 7-C are similarly rigidly connected to the inner surface of the upper bezel 4 such that inner prong 7-B lies between outer prongs 1-A and 1-B; and inner prong 7-C lies between outer prongs 1-B and 1-C, at two separate appropriate locations such that each of these two locations are equidistant from outer prong 1-B and are lying on two sides of the outer prong 1-B. Each of the inner prongs 7-A, 7-B, and 7-C has a groove at appropriate location and side to support an edge of a respective gem. Full length of each of these inner prongs lies above the bottom plane of the upper bezel 4. The level of top of all inner prongs is lying below the level of top of all outer prongs.

The third support for each of the gem is provided by a triangular prong 8 (not shown in FIG. 1, but shown in FIG. 7) with the centre thereof lying on central vertical axis of the elemental jewelry unit, that is, collet.

Figure 2:
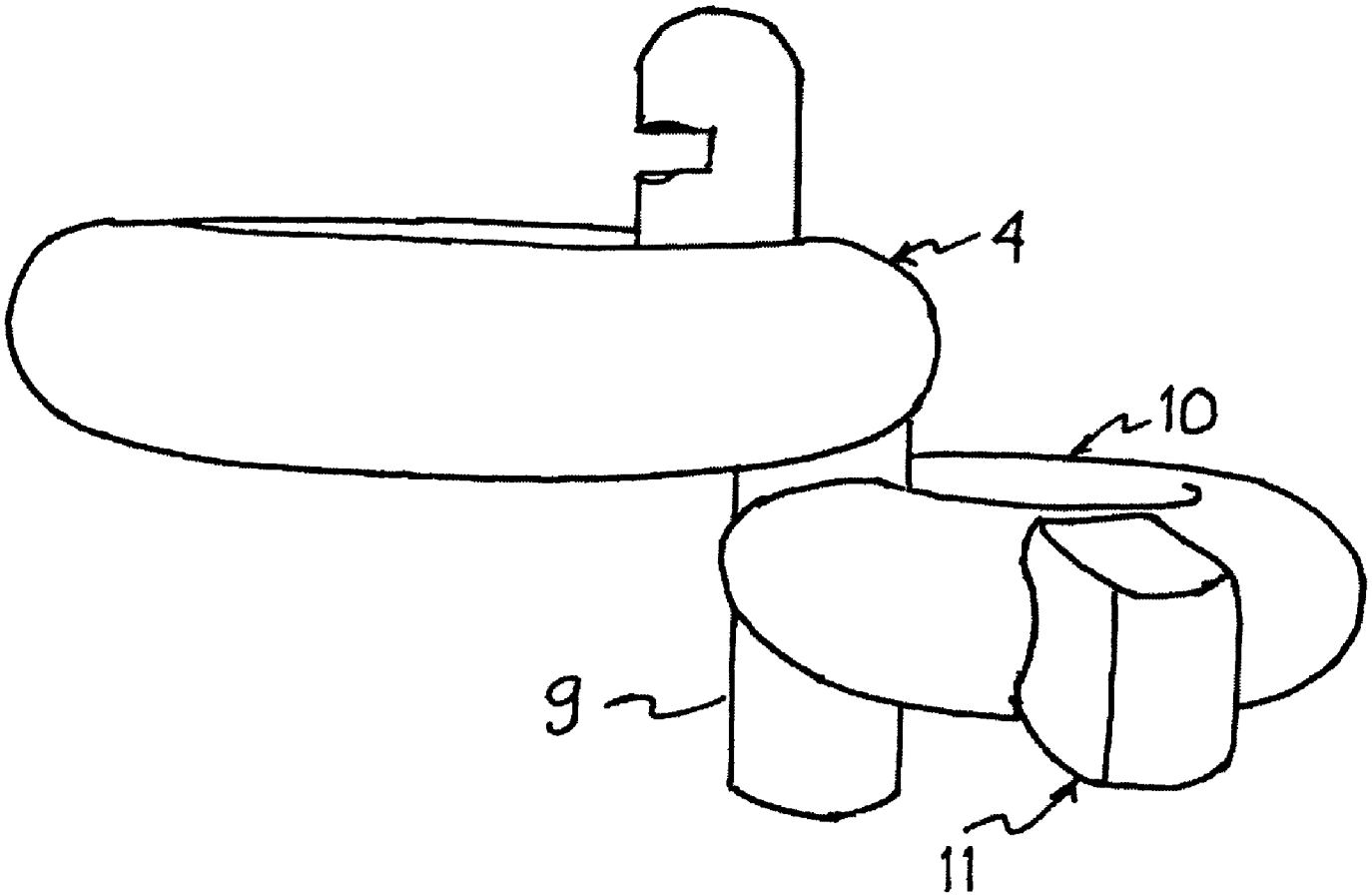
FIG. 2 shows a component of elemental jewelry unit with detailed arrangement of jump ring, rigid pin, stub and inner prong.
Figure 5:
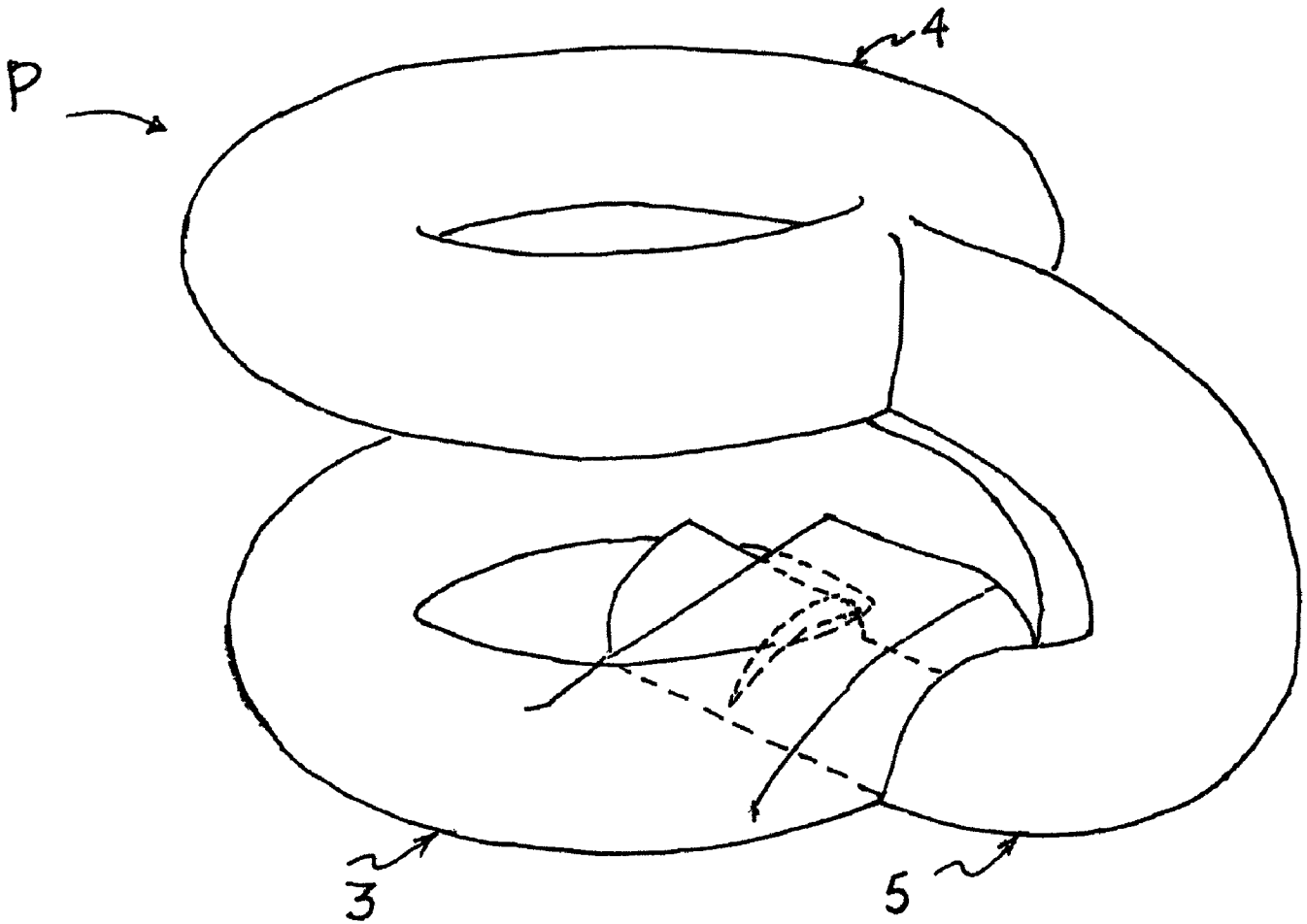
FIG. 5 shows arrangement of fixing bent wire into the groove of the lower bezel, to form a closed loop.

Referring to FIGS. 1, 2 and 5, a rigid stub 9 (FIG. 2) is rigidly connected at its upper and lower ends respectively to upper bezel 4 and lower bezel 3. The curved pin 5 and stub 9 are located on two sides of the outer prong 1-A. A jump ring 10 is rigidly connected to the stub 9, such that curved circular axis of wire forming jump ring 10, passes through vertical longitudinal axis of stub 9, and such that the jump ring 10 is approximately parallel to the lower and upper bezels 3 and 4. An appropriately shaped and sized rigid pin 11 is connected to the outer surface of jump ring 10 so that the rigid pin is positioned nearer to the outer prong 1-B and farther away from the outer prong 1-A. The lower bezel 3 has a groove 12 in its lower surface. When the curved pin 5 is appropriately bent, the balance metallic portion of the curved pin 5 near the slot 6 appropriately fits in this groove 12. The lower bezel 3 has a bulged up portion above this groove 12 for maintaining appropriate structural strength.

Figure 3:
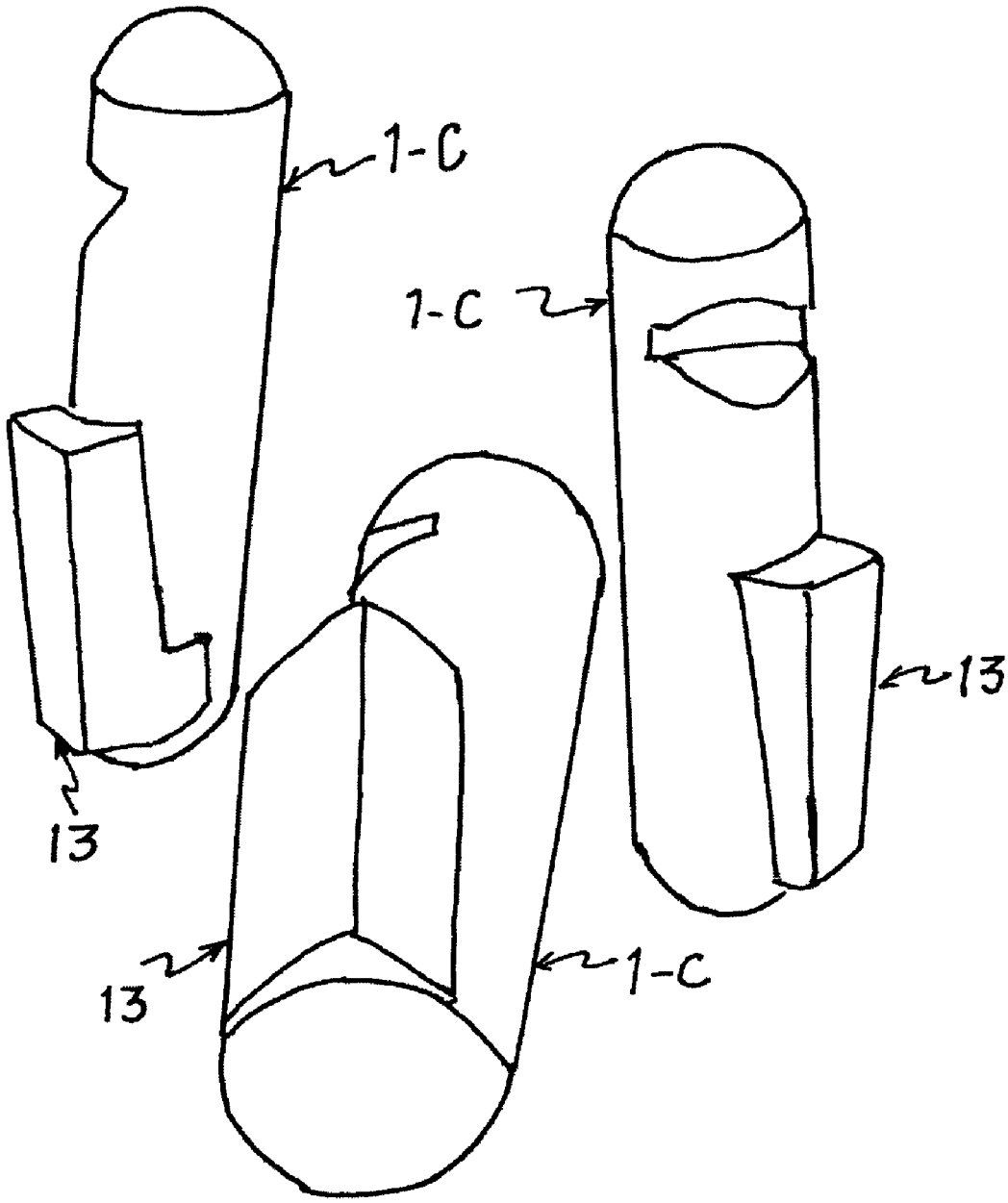
FIG. 3 shows the outer prong carrying the stopper.

Referring to FIGS. 1 and 3, an appropriately shaped and sized stopper 13 is rigidly fixed to the outer prong 1-C, such that the stopper 13 occupies some space between lower and upper bezels 3 and 4, the stopper 13 being rigidly attached to the inner surface of the outer prong 1-C. Three different views of stopper with outer prong 1-C are shown in FIG. 3.

Figure 4:
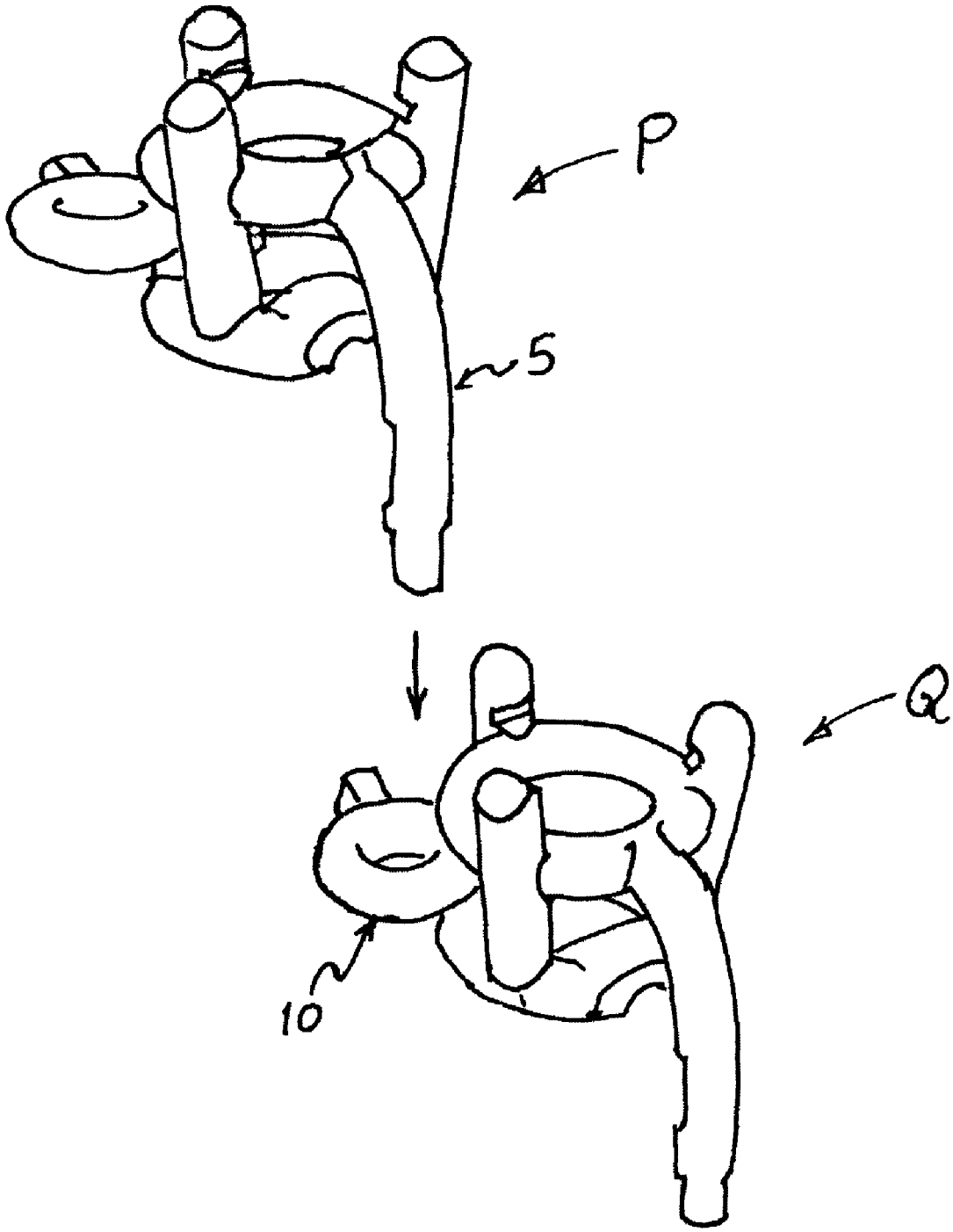
FIG. 4 shows two elemental jewelry units P and Q ready for assembly.

Referring to FIGS. 4 and 5, two collets, that is, two individual elemental jewelry units, P and Q, are placed such that curved pin 5 of collet P is ready to enter into central hollow space of jump ring 10 of collet Q as shown in FIG. 4. After passing through the central hollow space of jump ring 10 of collet Q, the curved pin 5 of collet P is bent as shown in FIG. 5, so that after bending the pin 5, the slot of bent curved pin 5 matches with the groove 12 of lower bezel 3 of collet P. Appropriate soldering is done to make the joint strong and rigid.

This procedure completes the formation of a hinge permitting rotational motion between curved pin of collet P and jump ring of collet Q relative to each other.

Figure 6:
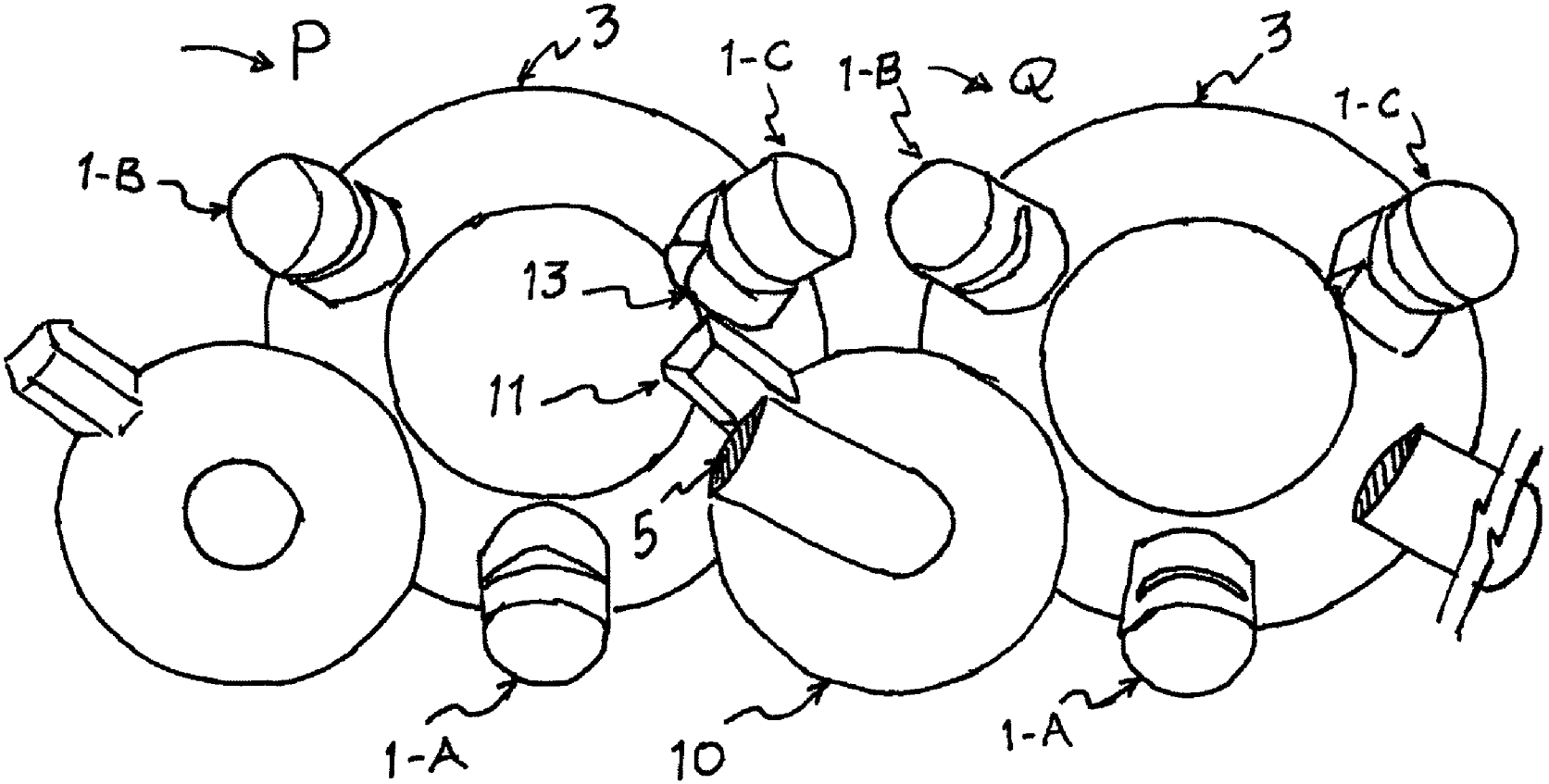
FIG. 6 shows stopper and rigid pin arrangement for limiting mutual free rotation between jump ring and the bent wire of closed loop.

In FIG. 6, the stopper 13, lower bezel 3, a part of curved pin 5 of collet P are shown. The FIG. 6 also shows lower bezel 3, and jump ring 10 of collet Q. The curved pin 5 of collet P is seen to be passing through hollow space of jump ring 10 of collet Q. The jump ring 10 of collet Q can rotate about the curved axis of curved pin 5 of collet P, in clockwise or anticlockwise direction as viewed from above. There is a limiting condition on amount of rotation on both of these rotational motions due to this type of hinge-construction.

In anticlockwise rotation of jump ring 10 of collet Q, the rotational motion is permitted only till the outer prong 1-C of collet P and outer prong 1-B of collet Q touch each other.

In clockwise rotation of jump ring 10 of collet Q, the rotational motion is permitted only till the rigid pin 11 of collet Q touches the stopper 13 of collet P.

The predetermined appropriate amounts of permitted clockwise or anticlockwise rotational motions of all jump rings of all individual elemental jewelry units of the jewelry item such as necklace will permit the necklace to take and retain the predetermined appropriate shape of necklace to achieve the gracefulness and beauty, and very attractive and impressive appearance, thereby overcoming the disadvantages and limitations of the hinge-construction of the prior art discussed earlier.

In view of above mentioned details of the present invention it is apparent to the person skilled in the art that the present invention basically comprises of the following two items;

Item 1

A novel type of hinge and its application in jewelry making, comprising a rotational-motion-limiting arrangement provided for each elemental jewelry unit of a plurality of elemental jewelry units sequentially interconnected for capably forming a jewelry item, wherein said arrangement, when provided for limiting maximum permissible amount of rotational motion of a respective jump ring of said elemental jewelry unit, comprises:

a. a jump ring provided in said elemental jewelry unit;
b. a curved pin provided in an adjacent elemental jewelry unit;
c. a rigid pin provided in said elemental jewelry unit;
d. a stopper provided in said adjacent elemental jewelry unit;
e. a stub provided in said elemental jewelry unit;
f. two respective sets of outer supporting prongs with one set provided in said elemental jewelry unit and another set in said adjacent elemental jewelry unit;
g. a set of bezels provided in said adjacent elemental jewelry unit;

wherein, said jump ring of step (a) is integrally joined to said elemental jewelry unit, preferably through said stub which is integrally joined thereto, said jump ring being disposed on one side of said elemental jewelry unit and located between two adjacent outer supporting prongs of respective set of prongs thereof;

wherein, said adjacent elemental jewelry unit is disposed in an appropriate location, such that said curved pin of step (b), whose one end is integrally secured to one bezel of said adjacent elemental jewelry unit and whose other free end, after passing through said jump ring forms a closed loop having U-shaped bend when said free end is integrally joined to appropriate bezel from respective set of bezels of said adjacent elemental jewelry unit, with said closed loop capably permitting smooth rotational motion of said jump ring in both the clockwise and anticlockwise directions;

wherein, said rigid pin of step (c) is integrally joined to said jump ring at an appropriate location thereof, with size of said rigid pin and said location being dependent on the appropriate predetermined maximum amount of permissible clockwise-rotational motion of said jump ring;

wherein, said stopper of step (d) is integrally joined to appropriate outer supporting prong from respective set of prongs of said adjacent elemental jewelry unit, with size of said stopper being dependent on said appropriate predetermined maximum amount of permissible clockwise rotational motion of said jump ring, wherein, said stopper and said rigid pin comprise clockwise-rotational-motion-limiting mating pair which capably permits said appropriate predetermined maximum amount of clockwise rotational motion of said jump ring;

wherein, two adjacent prongs, with one prong being disposed on said elemental jewelry unit at an appropriate location thereof and with another prong being disposed on said adjacent elemental jewelry unit at another appropriate location thereof, comprise anticlockwise-rotational-motion-limiting mating pair which capably permits respective appropriate predetermined maximum amount of permissible anticlockwise rotational motion of said jump ring; and wherein, similar set of bezels, set of outer supporting prongs and clockwise-rotational-motion-limiting mating pairs and anticlockwise-rotational-motion-limiting mating pairs are provided for all remaining elemental jewelry units of said plurality of elemental jewelry units of said jewelry item.

Item 2

A method of making a novel type of hinge for its application in jewelry making, wherein a separate rotational-motion-limiting arrangement is provided separately for each of clockwise and anticlockwise rotation of each elemental jewelry unit of a plurality of elemental jewelry units capably interconnected for forming a jewelry item, comprising the steps of:

a) joining integrally an appropriately shaped rigid pin to a jump ring of an elemental jewelry unit at an appropriate location thereof;
b) joining integrally an appropriately shaped stopper to an outer supporting prong of an adjacent elemental jewelry unit at an appropriate location thereof;
c) passing a curved pin of said adjacent elemental jewelry unit through said jump ring of step (a); further bending appropriately said curved pin and integrally securing free end thereof to an appropriate bezel of said adjacent elemental jewelry unit, thereby forming a closed loop capably permitting smooth rotational motion of said jump ring in clockwise direction and also in anticlockwise direction;
d) permitting an appropriate predetermined maximum amount of permissible clockwise rotational motion of said jump ring, with said maximum amount of step (d) being limited by mating of components of first mating pair comprising said stopper and said rigid pin;
e) permitting another appropriate predetermined maximum amount of permissible anticlockwise rotational motion of said jump ring, with said maximum amount of step (e) being limited by mating of components of second mating pair comprising one appropriately disposed prong of said elemental jewelry unit of step (a) and another appropriately disposed prong of said adjacent elemental jewelry unit of step (b); and
f) continuing work of formation of the two mating pairs similar to those of step (d) and step (e), for all other remaining elemental jewelry units capably providing similar rotational-motion-limiting arrangements.

While the above description contains many specificities, these should not be construed as limitation in the scope of the invention, but rather as an exemplification of the preferred embodiments thereof. Many other variations are possible. Accordingly, the scope of the invention should be determined not by the embodiments illustrated, but by the appended claims and their legal equivalents.

The invention claimed is:

1. A hinge and its application in jewelry making, comprising a rotational-motion-limiting arrangement provided for each elemental jewelry unit of a plurality of elemental jewelry units sequentially interconnected for capably forming a jewelry item, wherein said arrangement, when provided for limiting maximum permissible amount of rotational motion of a respective jump ring of said elemental jewelry unit, comprises:

a. a jump ring provided in said elemental jewelry unit;

b. a curved pin provided in an adjacent elemental jewelry unit;

c. a rigid pin provided in said elemental jewelry unit;

d. a stopper provided in said adjacent elemental jewelry unit;

e. a stud provided in said elemental jewelry unit;

f. two respective sets of outer supporting prongs with one set provided in said elemental jewelry unit and another set in said adjacent elemental jewelry unit;

g. a set of bezels provided in said adjacent elemental jewelry unit;

wherein, said jump ring of element (a) is integrally joined to said elemental jewelry unit, said jump ring being disposed on one side of said elemental jewelry unit and located between two adjacent outer supporting prongs of respective set of prongs thereof;

wherein said adjacent elemental jewelry unit is disposed in an appropriate location, such that said curved pin of element (b), whose one end is integrally secured to one bezel of said adjacent elemental jewelry unit and whose other free end, after passing through said jump ring forms a closed loop having U-shaped bend when said free end is integrally joined to appropriate bezel from respective set of bezels of said adjacent elemental jewelry unit, with said closed loop capably permitting smooth rotational motion of said jump ring in both the clockwise and anticlockwise directions;

wherein, said rigid pin of element (c) is integrally joined to said jump ring at an appropriate location thereof, with size of said rigid pin and said location being dependent on the appropriate predetermined maximum amount of permissible clockwise-rotational motion of said jump ring;

wherein, said stopper of element (d) is integrally joined to appropriate outer supporting prong from respective set of prongs of said adjacent elemental jewelry unit, with size of said stopper being dependent on said appropriate predetermined maximum amount of permissible clockwise rotational motion of said jump ring, wherein, said stopper and said rigid pin comprise clockwise-rotational-motion-limiting mating pair which capably permits said appropriate predetermined maximum amount of clockwise rotational motion of said jump ring;

wherein, two adjacent prongs, with one prong being disposed on said elemental jewelry unit at an appropriate location thereof and with another prong being disposed on said adjacent elemental jewelry unit at another appropriate location thereof, comprise anticlockwise-rotational-motion-limiting mating pair which capably permits respective appropriate predetermined maximum amount of permissible anticlockwise rotational motion of said jump ring; and wherein, similar set of bezels, set of outer supporting prongs and clockwise-rotational-motion-limiting mating pairs and anticlockwise-rotational-motion-limiting mating pairs are provided for all elemental jewelry units of said plurality of elemental jewelry units of said jewelry item.

2. A method of making a hinge for its application in jewelry making, wherein a separate rotational-motion-limiting arrangement is provided separately for each of clockwise and anticlockwise rotation of each elemental jewelry unit of a plurality of elemental jewelry units capably interconnected for forming a jewelry item, comprising the steps of:

a) joining integrally a shaped rigid pin to a jump ring of an elemental jewelry unit;

b) joining integrally a shaped stopper to an outer supporting prong of an adjacent elemental jewelry unit;

c) passing a curved pin of said adjacent elemental jewelry unit through said jump ring of step (a); further bending said curved pin and integrally securing a free end thereof to a bezel of said adjacent elemental jewelry unit, thereby forming a closed loop capably permitting smooth rotational motion of said jump ring in clockwise direction and also in anticlockwise direction;

d) permitting a predetermined maximum amount of permissible clockwise rotational motion of said jump ring, with said maximum amount of step (d) being limited by mating of components of first mating pair comprising said stopper and said rigid pin;

e) permitting another predetermined maximum amount of permissible anticlockwise rotational motion of said jump ring, with said maximum amount of step (e) being limited by mating of components of second mating pair comprising one prong of said elemental jewelry unit of step (a) and another prong of said adjacent elemental jewelry unit of step (b); and f) continuing work of formation of the two mating pairs similar to those of step (d) and step (e), for all other remaining elemental jewelry units capably providing similar rotational-motion-limiting arrangements.

3. The hinge of claim 1, in which said jump ring of element (a) is integrally joined to said elemental jewelry unit through said stud which is integrally joined thereto.

* * * * *